US008127694B2

(12) United States Patent
Low

(10) Patent No.: US 8,127,694 B2
(45) Date of Patent: Mar. 6, 2012

(54) PORTABLE, SELF-CONTAINED PC-CAMERA WORKSTATION

(76) Inventor: George John Low, Carson City, NV (US)

( * ) Notice: Subject to any disclaimer, the term of this patent is extended or adjusted under 35 U.S.C. 154(b) by 1309 days.

(21) Appl. No.: 11/586,012

(22) Filed: Feb. 1, 2007

(65) Prior Publication Data

US 2008/0185945 A1 Aug. 7, 2008

(51) Int. Cl.
*A47B 3/00* (2006.01)

(52) U.S. Cl. ..... 108/115; 108/29

(58) Field of Classification Search ..... 108/115, 108/132, 131, 28, 29; 248/125.8, 129, 127, 248/145.6, 150, 155.1, 161, 157, 166, 170, 248/439; 352/243
See application file for complete search history.

(56) References Cited

U.S. PATENT DOCUMENTS

| | | | | | |
|---|---|---|---|---|---|
| 120,030 | A * | 10/1871 | Brown et al. | 108/132 |
| 319,915 | A * | 6/1885 | Linsley et al. | 108/36 |
| 324,320 | A * | 8/1885 | Hanson | 108/36 |
| 390,173 | A * | 9/1888 | Jones | 108/132 |
| 2,693,258 | A * | 11/1954 | Fleisch | 108/36 |
| 3,326,337 | A * | 6/1967 | Bell | 108/36 |
| 4,119,044 | A * | 10/1978 | Hines | 108/27 |
| 4,927,128 | A * | 5/1990 | O'Brian | 108/36 |
| 4,969,496 | A * | 11/1990 | Romans | 108/132 |
| 5,067,417 | A * | 11/1991 | Marmentini et al. | 108/36 |
| 5,660,117 | A * | 8/1997 | Noble | 108/35 |
| 5,786,854 | A | 7/1998 | Slade et al. | |
| 5,908,181 | A | 6/1999 | Valles-Navarro | |
| 5,921,523 | A | 7/1999 | South et al. | |
| 6,113,050 | A | 9/2000 | Rush | |
| 6,282,084 | B1 | 8/2001 | Goerdt et al. | |
| 6,493,220 | B1 | 12/2002 | Clark et al. | |
| 6,520,642 | B1 * | 2/2003 | Chapman | 352/243 |
| 6,604,720 | B1 | 8/2003 | Wilson | |
| 6,712,008 | B1 | 3/2004 | Habenicht et al. | |
| 2006/0130718 | A1 * | 6/2006 | Lo et al. | 108/131 |

* cited by examiner

*Primary Examiner* — Jose V Chen
(74) *Attorney, Agent, or Firm* — Donald E. Schreiber

(57) ABSTRACT

A portable, collapsible, self-contained workstation having a substantially planar platform adapted for receiving a lap-top computer. A pair of doors, extendable away from the platform, are hinged from a lower surface of the platform. The workstation also preferably includes four (4), adjustable-length legs with a pair of legs being secured to each of the doors. The doors extending away from the platform and the legs being adapted for supporting the platform from a surface. The workstation includes a handle that is that secured to the platform and is disposable and fixable to extend above the platform. When disposed above the platform, the handle is adapted for receiving and having affixed thereto an instrument or a camera.

11 Claims, 11 Drawing Sheets

PORTABLE, SELF-CONTAINED PC-CAMERA WORKSTATION

BACKGROUND

1. Technical Field

The present invention relates to computer workstations, and more particularly to a portable, collapsible, stable, easily re-locatable workstation for supporting a lap-top computer, and that also supports a digital instrument or digital photographic equipment used in conjunction with the lap-top computer.

2. Background Art

With the advent of digital devices used in field work it becomes advantageous to have a platform that:

1. allows an individual to transport the equipment to a work site; and
2. incorporates a work surface together with a mount for supporting digital devices such as a camera or an instrument.

Professional photographers use an assortment of gear when setting up for a remote photo shoot. Presently, when a lap-top computer and digital photographic equipment are used together, the equipment may be assembled away from the shooting location rather than being transported to the location and assembled there. Conventional photographic supporting systems, such as tripod, generally lack a work platform for supporting a lap-top computer being used in conjunction with a digital camera or instrument.

U.S. Pat. No. 5,786,854 ("the '854 patent") discloses a portable, self-contained telescoping camera tower system. The camera tower is a stand-alone unit having a tripod base that is capable of being transported, set up and operated by a single individual. The system provides steady raising and lowering of the tower over its full range of up and down movement. An arrangement of pulleys, bearing surfaces, and drive means, preferably with two power-up drives and a separate power-down drive, assures smooth operation though its full operating range for elevating and lowering a camera. The '854 patent also discloses a control unit, supported on the camera tower, that is used to control operation both of the tower power drives, and of a pan and tilt unit atop the tower supporting the camera. The control unit typically includes a joystick for operating the pan and tilt unit. A video monitor can also be supported on the camera tower to aid in camera control. The '854 patent fails to disclose a work platform for supporting a lap-top computer.

U.S. Pat. No. 6,282,084 discloses a support apparatus that uses a plurality of legs removably coupled to a pedestal upon which a portable computer rests. The pedestal includes a storage compartment that is adapted for storing the removable legs when not in use. Including a storage compartment within the pedestal reduces the overall bulk of the support apparatus, and permits transporting as a unit all components of the support apparatus.

U.S. Pat. No. 6,493,220 discloses a mobile workstation that includes both an adjustable-height horizontal tray and a pull-out tray mounted beneath the horizontal tray for supporting a keyboard. The horizontal tray supports a device, such as computer terminal, in a vertical orientation with:

1. a tiltable docking station mounted atop the horizontal tray; or
2. a mounting bracket mounted adjacent to the horizontal tray.

The mobile workstation also carries a power unit including an extended-life battery and a battery charger that connects to an AC power supply to charge the conventional battery pack connected to the computer terminal as well as the extended-life battery carried on the mobile workstation. A chassis, that includes a wheeled dolly assembly above which projects an adjustable pedestal, supports mobile workstation's horizontal tray. The wheeled dolly assembly allows an operator to easily move the mobile workstation from place to place.

U.S. Pat. No. 6,604,720 discloses a portable laptop computer workstation that includes a first work space having a rectangular planar table for supporting a laptop computer. A lower surface of the planar table rests upon a Tee-shaped receiver having a pair of longitudinal legs parallel to one edge of the planar table, and a transverse leg normal to the longitudinal legs. The Tee-shaped receiver rests on a conventional camera tripod for supporting the planar table, and is adapted for receiving and mechanically supporting additional work spaces.

U.S. Pat. No. 6,712,008 portable computer workstation assembly for enabling a computer's use from a comfortable position such as from a lounge chair or a bed. The portable computer workstation assembly includes a base assembly having an elongate base member and a pair of leg members securely attached at opposite ends of the elongate base member. The base assembly's elongate base member supports a vertically oriented, upright housing tower. A height adjustment assembly, attached to the upright housing tower, supports both an adjustable keyboard support assembly, and above the keyboard support assembly an adjustable monitor support assembly. A central processing unit support member is fixed to one side of the housing tower.

BRIEF SUMMARY

An object of the present disclosure is to alleviate problems arising from using digital instruments and cameras in field work.

Another object of the present disclosure is to provide a workstation having a platform that facilitates working with digital instruments and cameras in the field.

Yet another object of the present invention is to provide a workstation that facilitates transporting components of the portable workstation together with a lap-top computer and a digital camera or instrument.

Yet another object of the present invention is to provide a workstation that is compact when transporting components of the portable workstation together with a lap-top computer and a digital camera or instrument.

Briefly, disclosed herein is a portable, collapsible, self-contained workstation having a substantially planar platform adapted for receiving a lap-top computer. A pair of doors are respectively located beneath the platform, each door being hinged from the platform to be disposable and fixed in at least two (2) differing orientations. One orientation when the workstation is collapsed positions the doors against a lower surface of the platform. A second orientation arranges the doors so they extend away from the platform. The workstation also includes at least three (3) legs which are adjustable at least in length, and are adapted, together with the doors, for supporting the platform from a surface. A first pair of the legs are secured to a first of the doors and at least another of the legs are secured to a second of the doors. Preferably, the workstation includes four (4) legs with a pair of legs being secured to each of the doors. When the doors are oriented to extend away from the platform the legs are:

1. extendable away from the platform and fixable in the extended configuration; and
2. collapsible toward the platform.

Finally, the workstation includes a handle that is that secured to the platform and is disposable and fixable in at least two (2) differing orientations. When the platform is being supported from a surface by the legs and the doors, one orientation of the handle is that in which the handle extends above the platform thereby adapting the handle for receiving and having affixed thereto an instrument or a camera.

The disclosed workstation provides a stable, adjustable portable platform when working with digital media, digital instruments, digital photography, and fine or graphic arts. An advantage of the preferred portable workstation of the present disclosure is that its two (2) doors and legs can be positioned to diverge away from each other thereby increasing stability. Another advantage of a preferred embodiment of the portable workstation which includes a pair of wheels is that, when collapsed, the instrument or camera mounting handle can be used to pull the collapsed workstation across a surface.

These and other features, objects and advantages will be understood or apparent to those of ordinary skill in the art from the following detailed description of the preferred embodiment as illustrated in the various drawing figures.

DETAILED DESCRIPTION

Figure 1:
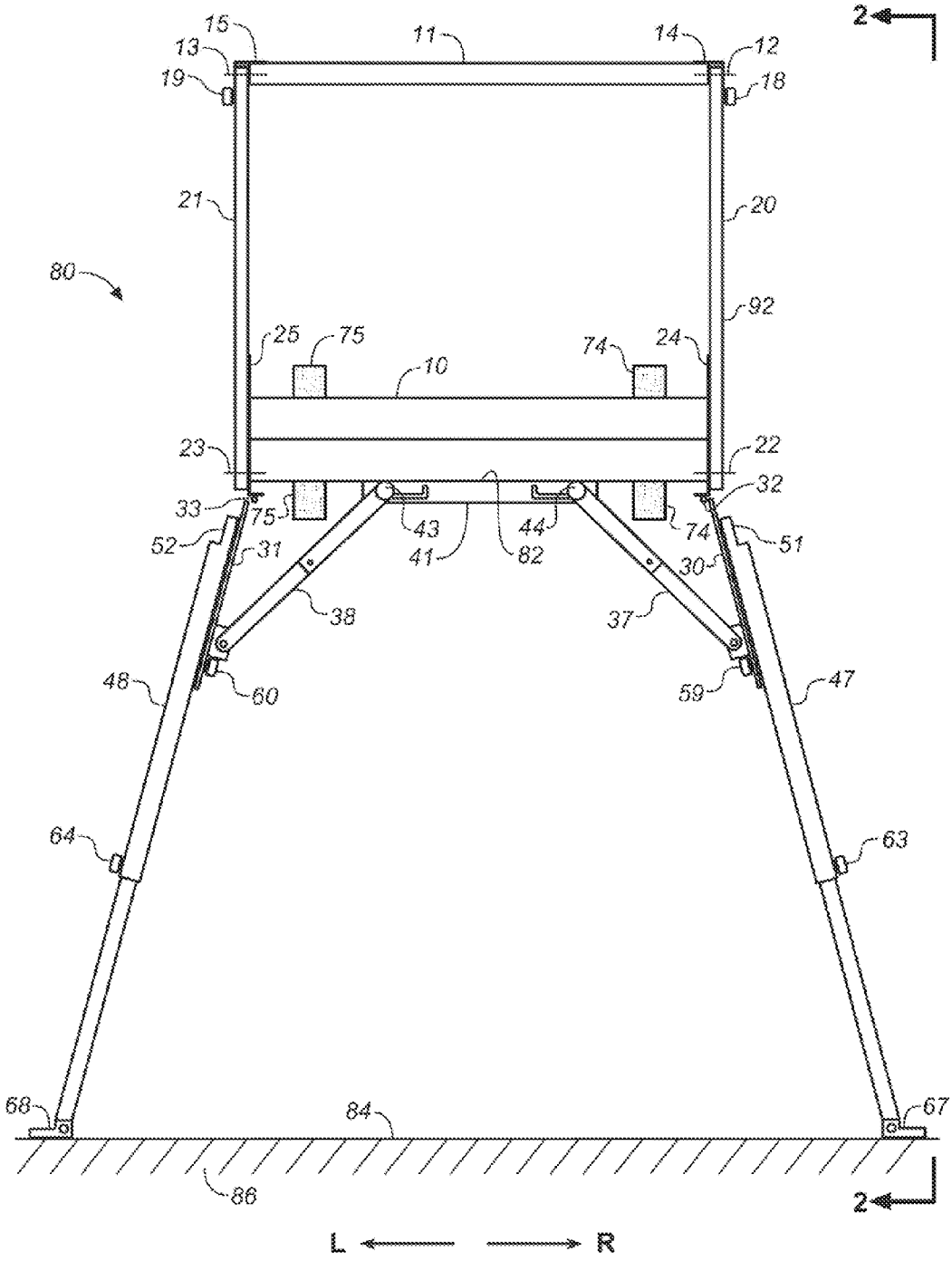
FIG. 1 is a front elevational view of a portable, self-contained pc-camera workstation supported from the ground by doors and adjustable legs.
Figure 2:
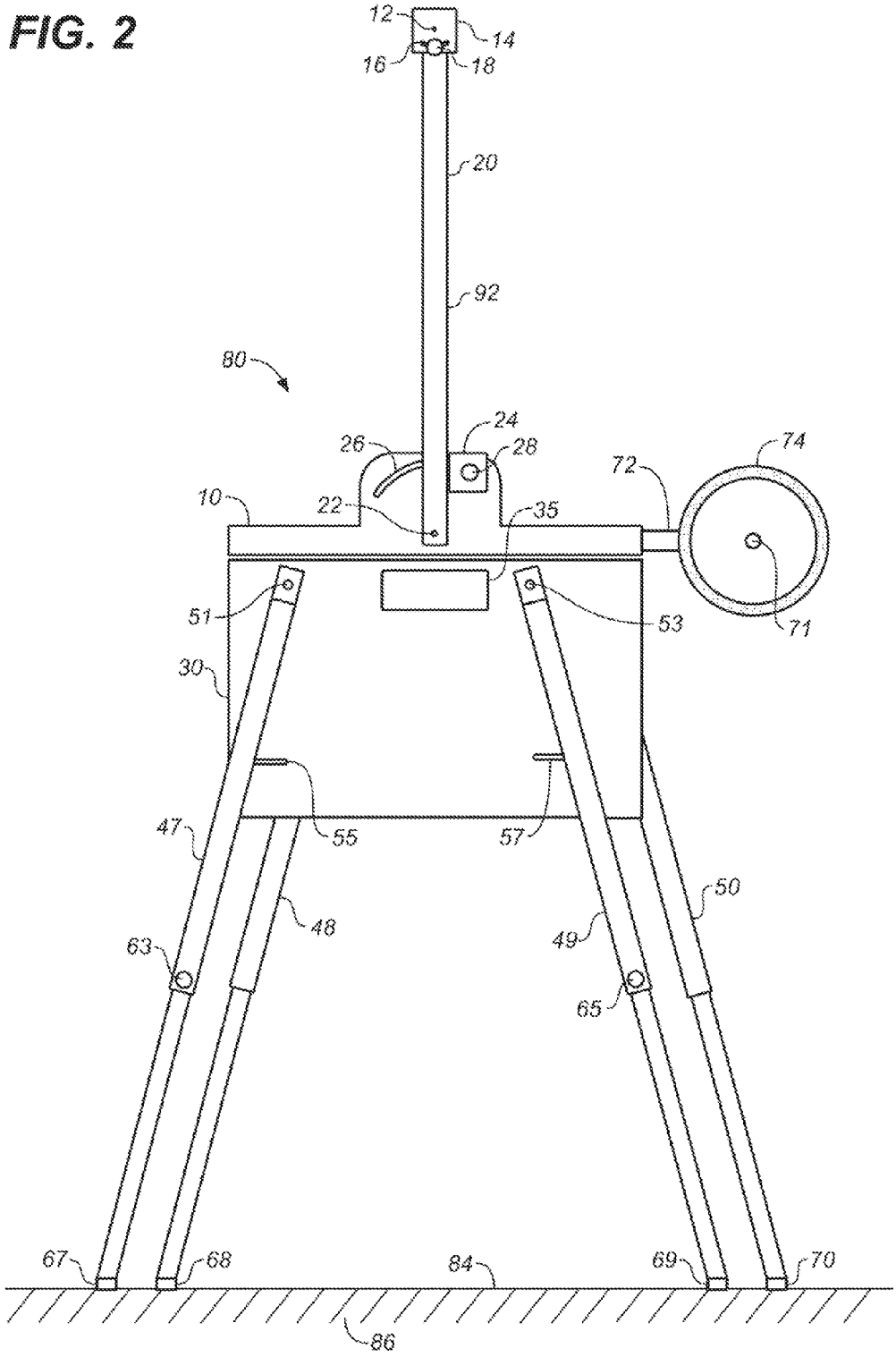
FIG. 2 is a side elevational view of the portable, self-contained pc-camera workstation resting on the ground taken along the line 2-2 in FIG. 1.
Figure 3:
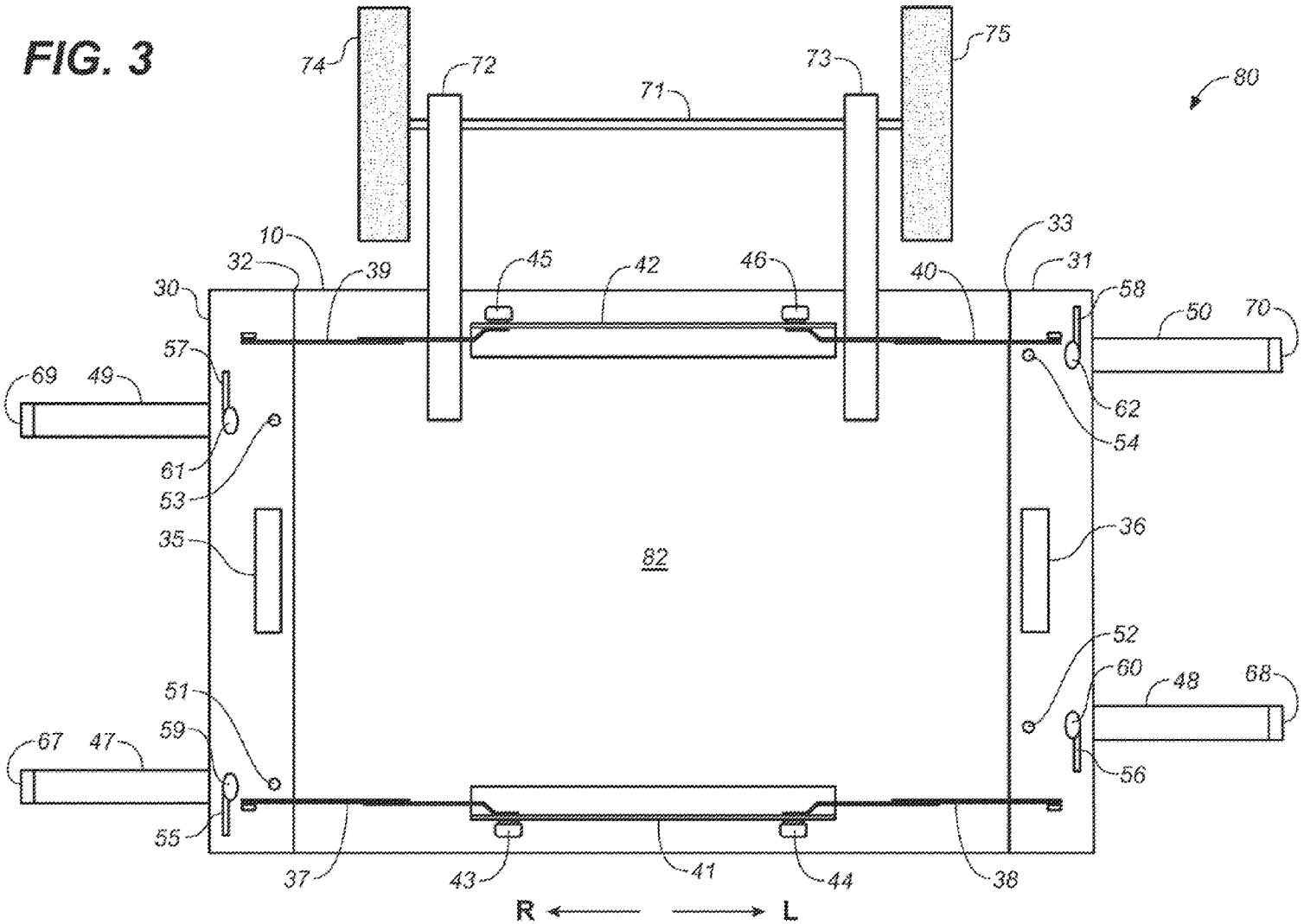
FIG. 3 a plan view of the portable, self-contained pc-camera workstation as illustrated in FIGS. 1 and 2 taken from below at ground level.

FIGS. 1 through 3 illustrate a portable, collapsible, self-contained workstation that is referred to by the general reference character 80. The workstation 80 includes a substantially planar work platform 10 that is adapted for receiving a lap-top computer. In the illustrations of FIGS. 1 through 3, a right-hand door 30 and a left-hand door 31 are located beneath the platform 10. An upper edge of the right-hand door 30 is secured to the platform 10 along a right-hand side thereof by a right-hand door hinge 32, while an upper edge of the left-hand door 31 is correspondingly secured to the platform 10 along a left-hand side thereof by a left-hand door hinge 33. The doors 30, 31 have a width perpendicular to the hinges 32, 33 that does not exceed one-half the width of the platform 10 between the hinges 32, 33. As best illustrated in FIG. 3, each of the doors 30, 31 is respectively pierced by handholds 35, 36 which facilitate carrying the workstation 80.

As best illustrated in FIGS. 1 and 3, lower ends respectively of a collapsible right-hand front angle brace 37 and of a collapsible left-hand front angle brace 38 are secured by respective pin hinges near lower edges respectively of the doors 30, 31. A front angle brace slide front attachment 41 is secured to a lower surface 82 of the platform 10. Upper ends respectively of the front angle braces 37, 38 are secured to the front angle brace slide front attachment 41 by threaded pins which extend through respective U-shaped slots that pierce the front attachment 41. As best illustrated in FIG. 3, lower ends respectively of a collapsible right-hand rear angle brace 39 and of a collapsible left-hand rear angle brace 40 are correspondingly secured by pin hinges near lower edges respectively of the doors 30, 31. Correspondingly, upper ends respectively of the rear angle braces 39, 40 are secured to a rear angle brace slide rear attachment 42 by threaded pins which extend through respective U-shaped slots that pierce the rear attachment 42. The rear angle brace slide rear attachment 42 is also secured to the lower surface 82 of the platform 10. At the upper ends of the angle braces 37, 38, 39, 40, angle brace locks 43, 44, 45, 46 are respectively threaded onto the pins that respectively pass through the U-shaped slots piercing the attachments 41, 42. Positioning upper ends of the angle braces 37, 38, 39, 40 at either end of the U-shaped slots piercing the attachments 41, 42 facilitates fixing the doors 30, 31 in one or the other of two (2) orientations. One fixed orientation is that best illustrate in FIG. 1 with the doors 30, 31 extending away from the platform 10. The other fixed orientation, required for the doors 30, 31 when the workstation 80 is collapsed, is that in which the doors 30, 31 are folded against the lower surface 82 of the platform 10. A door lock 34, depicted in FIGS. 7 through 9 and 11, secures the doors 30, 31 in their collapsed configuration oriented against the lower surface 82 of the platform 10.

As best illustrated in FIGS. 2 and 3, a right-hand front leg 47 and a right-hand rear leg 49 are secured by respective right-hand hinge pins 51, 53 to the right-hand door 30 near the right-hand door hinge 32. As illustrated in FIG. 2, a left-hand front leg 48 and a left-hand rear leg 50 are secured by respective left hand hinge pins 52, 54 to the left-hand door 31 near the left-hand door hinge 33.

The right-hand door 30 is pierced by an arcuate right-hand front leg orientation slot 55 and by an arcuate right-hand rear leg orientation slot 57. Correspondingly, the left-hand door 31 is pierced by an arcuate left-hand front leg orientation slot 56 and by an arcuate left-hand rear leg orientation slot 58. Threaded leg locks 59, 60, 61, 62 extend through the respective leg orientation slots 55, 56, 57, 58 into the respective legs 47, 48, 49, 50. Tightening the leg locks 59, 60, 61, 62 against the doors 30, 31 permits fixing the legs 47, 48, 49, 50 anywhere along the respective arcuate leg orientation slots 55, 56, 57, 58 in any arbitrarily selected orientation. Combining the orientation for the doors 30, 31 extending away from the platform 10 that is illustrated in FIG. 1 and suitable orientations of the legs 47, 48, 49, 50 permitted by the arcuate leg orientation slots 55, 56, 57, 58 permits configuring the legs 47, 48, 49, 50 so they diverge away from each other as clearly illustrated in FIG. 3. Divergence of the legs 47, 48, 49, 50 away from each other improves stability of the workstation 80 when supported by the legs 47, 48, 49, 50.

The legs 47, 48, 49, 50 are preferably all adjustable in length by being of telescoping construction with a smaller cross-sectional lower section of each legs 47, 48, 49, 50 being slidable into a larger cross-sectional upper section thereof. With the doors 30, 31 configured as illustrated in FIG. 1, each of the legs 47, 48, 49, 50 are individually extendable away from the platform 10 and collapsible toward the platform 10. Leg extension locks 63, 64, 65, 66, all of which appear in FIG. 9, respectively located at the lower end of each upper section of the legs 47, 48, 49, 50, permit locking the lower section of each legs 47, 48, 49, 50 at any desired extension away from the platform 10. Hinged feet 67, 68, 69, 70, located respectively at the lower end of each of the legs 47, 48, 49, 50, rest on and conform with a surface 84 when the legs 47, 48, 49, 50 and the doors 30, 31 support the platform 10 from the ground 86.

Figure 6:
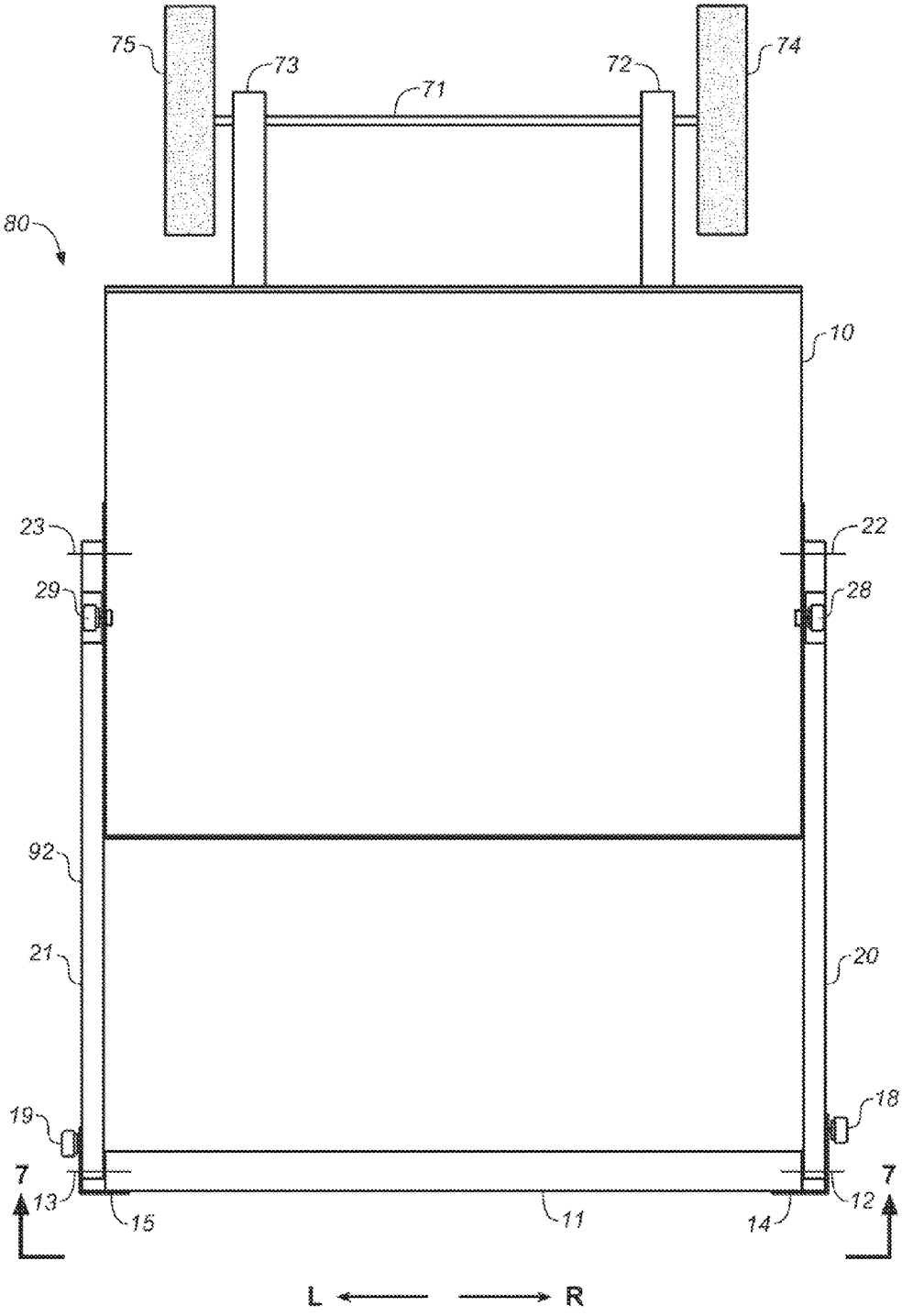
FIG. 6 a plan view of the portable, self-contained pc-camera workstation in the fully collapsed configuration taken from above.
Figure 7:
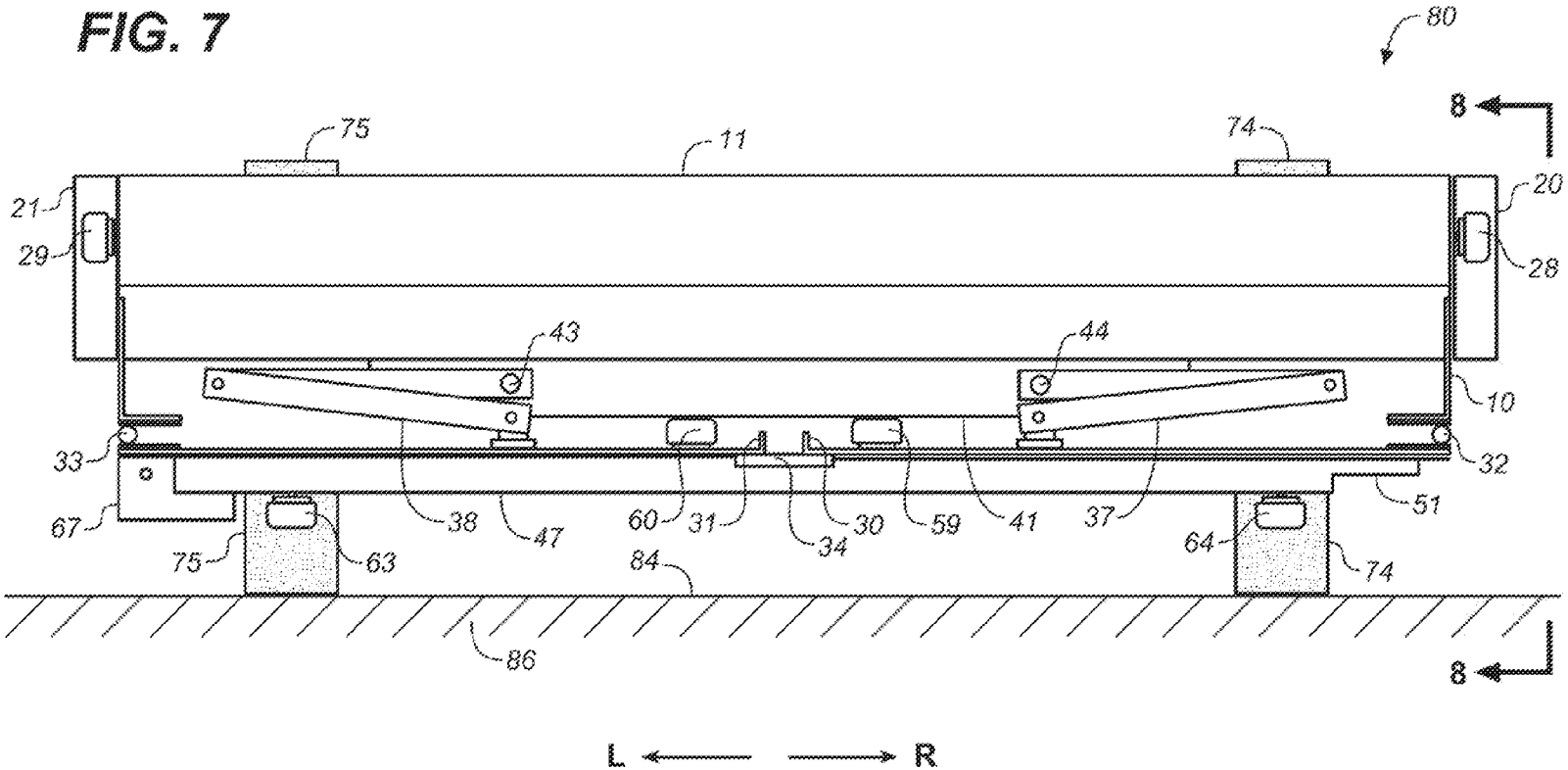
FIG. 7 is a front elevational view of the portable, self-contained pc-camera workstation in the fully collapsed configuration resting on the ground taken along the line 7-7 in FIG. 6.

Referring again to FIGS. 1 and 2, the workstation 80 also includes a handle 92 that is formed by a vertically oriented right-hand arm 20, a horizontally oriented instrument mounting bar 11, and a vertically oriented left-hand arm 21. Lower ends of the arms 20, 21 are supported from sides of the platform 10 respectively by a right-hand arm pivot 22 and by a left-hand arm pivot 23. The pivots 22, 23 permit rotation of the arms 20, 21 with respect to the platform 10. Projecting above the substantially planar platform 10 adjacent to lower ends respectively of the right-hand arm 20 and of the left-hand arm 21 are respectively a right-hand arm bracket 24 and a left-hand arm bracket 25. An arcuate right-hand arm slot 26 pierces the right-hand arm bracket 24, and correspondingly a left-hand arm slot 27, not illustrated in any FIG., pierces the left-hand arm bracket 25. A right-hand arm lock 28, secured to the right-hand arm 20 near a lower end thereof, extends through the right-hand arm slot 26. Correspondingly, a left-hand arm lock 29, secured to the left-hand arm 21 near a lower end thereof and illustrated in FIGS. 6 and 7, extends through the left-hand arm slot 27. Releasing both of the locks 28, 29 permits rotating the arms 20, 21 with respect to the platform 10 to any arbitrarily selected orientation permitted by the slots 26, 27. Securing both of the locks 28, 29 fixes the arms 20, 21 with respect to the platform 10 at any arbitrarily selected orientation permitted by the slots 26, 27. Orienting the handle 92 so it extends above the platform 10 adapts the instrument mounting bar 11 for receiving and having affixed thereto either an instrument or camera.

Secured to opposite ends of the instrument mounting bar 11 are respectively a right-hand arm upper bracket 14 and a left-hand arm upper bracket 15. The instrument mounting bar 11 is supported between upper ends of the arms 20, 21 respectively by means of:

1. a right-hand instrument bar pivot 12 which extends from the instrument mounting bar 11 through the right-hand arm upper bracket 14; and
2. a left-hand instrument bar pivot 13 which extends from the instrument mounting bar 11 through the left-hand arm upper bracket 15.

Figure 10:
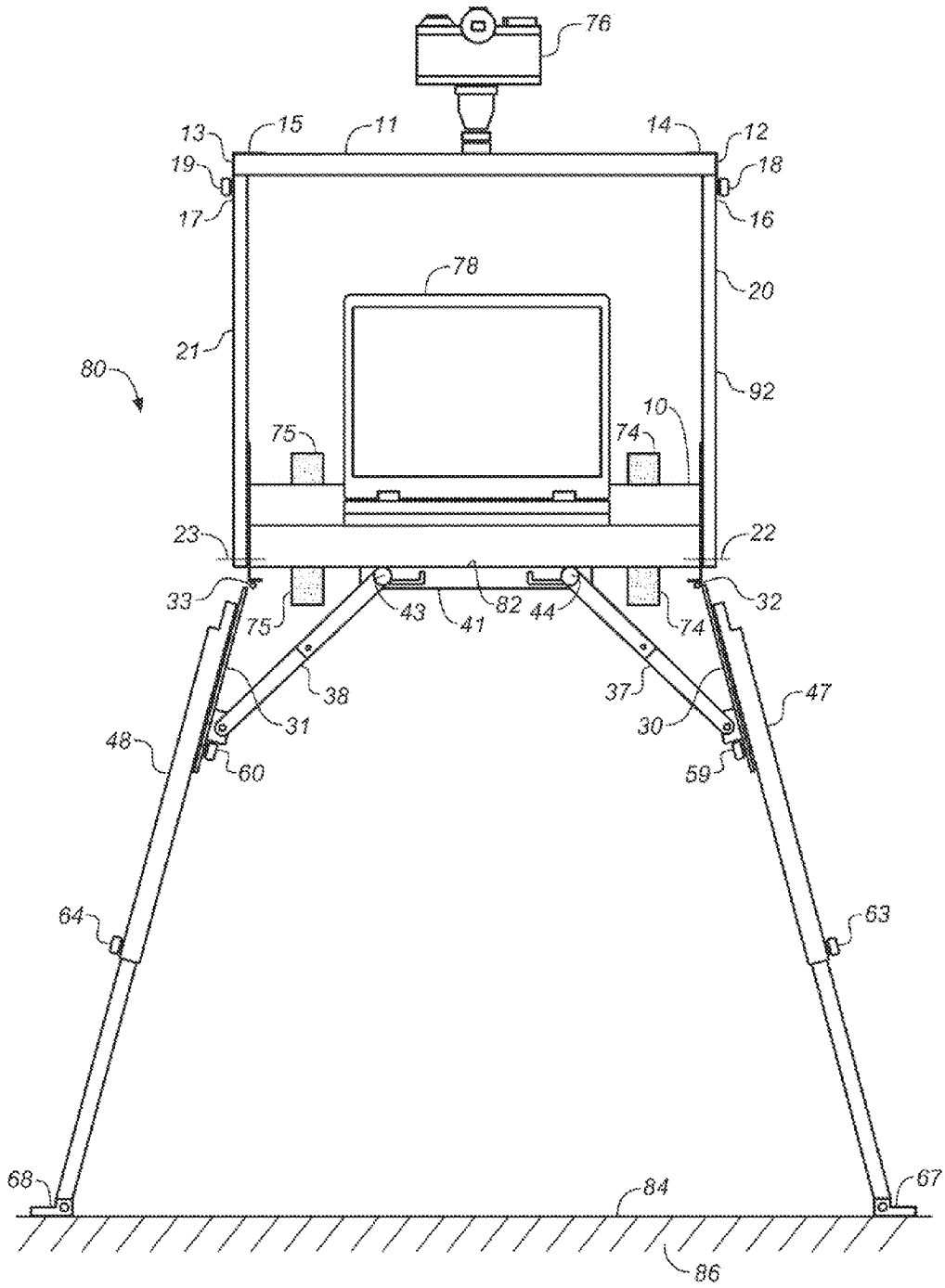
FIG. 10 is a front elevational view of a portable, self-contained pc-camera workstation similar to that of FIG. 1 showing a lap-top computer supported thereon and a digital camera secured thereto.

An arcuate right-hand instrument bar slot 16 pierces the right-hand arm upper bracket 14, and correspondingly a left-hand instrument bar slot 17, illustrated in FIG. 10, pierces the left-hand arm upper bracket 15. A right-hand instrument bar lock 18 extends through the right-hand instrument bar slot 16 to the right-hand arm 20. Correspondingly, a left-hand instrument bar lock 19 extends through the left-hand instrument bar slot 17 to the left-hand arm 21. Releasing both of the locks 18, 19 permits rotating the instrument mounting bar 11 with respect to the arms 20, 21 to any arbitrarily selected orientation permitted by the slots 16, 17. Securing both of the locks 18, 19 fixes the instrument mounting bar 11 with respect to the arms 20, 21 at any arbitrarily selected orientation permitted by the slots 16, 17. A camera secured to the instrument mounting bar 11 can be arbitrarily set to practically any desired pitch angle by rotating the instrument mounting bar 11 with respect to the arms 20, 21 and by rotating the arms 20, 21 with respect to the platform 10.

FIG. 10 depicts the workstation 80 in the same configuration as that of FIG. 1 with the handle 92 oriented so it extends above the platform 10. In the illustration of FIG. 10 a camera 76 is received upon and affixed to the instrument mounting bar 11. Beneath the camera 76, a lap-top computer 78 rests upon the platform 10.

As best illustrated in FIG. 3, a right-hand axle mounting bar 72, secured to the lower surface 82 beneath the platform 10 near one end of the rear attachment 42, projects outward from the platform 10. Correspondingly, a left-hand axle mounting bar 73, also secured to the lower surface 82 beneath the platform 10 near an opposite end of the rear attachment 42, also projects outward from the platform 10. An axle 71 spans between the bars 72, 73 and extends outward beyond both of them. A right-hand wheel 74 is attached to an end of the axle 71 extending to the right beyond the right-hand axle mounting bar 72, and a left-hand wheel 75 is attached to an opposite end of the axle 71 extending to the left beyond the left-hand axle mounting bar 73. The wheels 74, 75 are respectively secured to the axle 71 by split pins.

Figure 4:
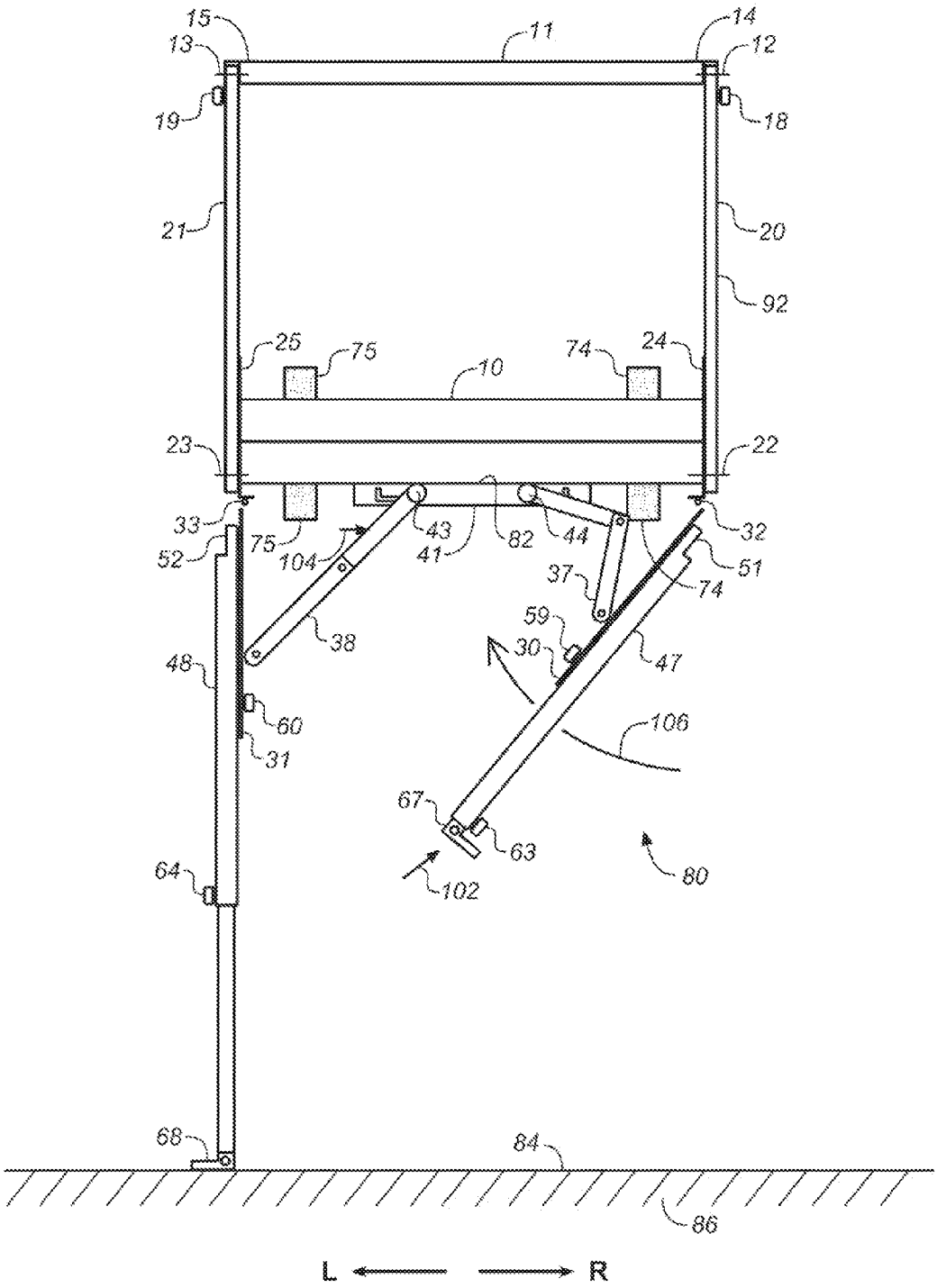
FIG. 4 is a front elevational view of the portable, self-contained pc-camera workstation, similar to the view of FIG. 1, illustrating alternative positions for doors and adjustable legs during transition to a collapsed configuration.
Figure 5:
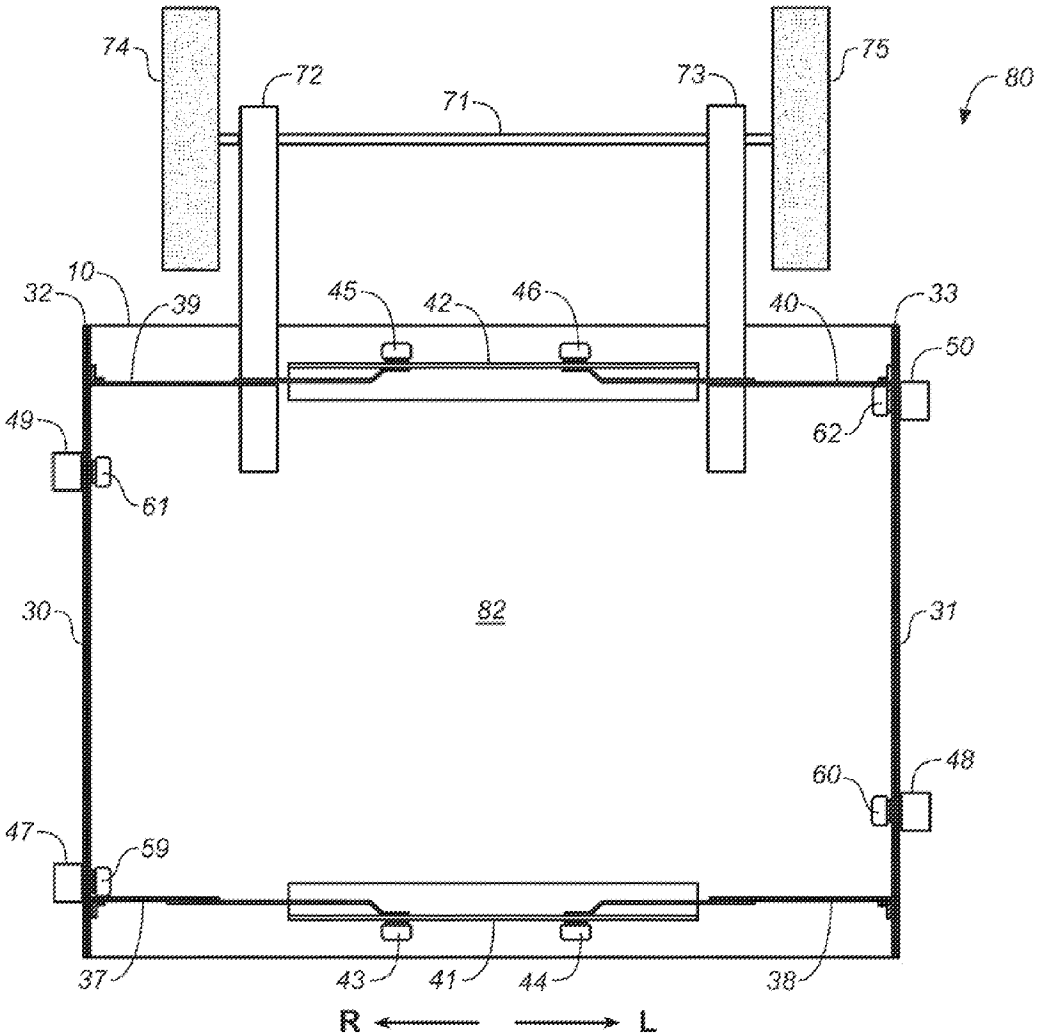
FIG. 5 a plan view of the portable, self-contained pc-camera workstation similar to that illustrated in FIG. 4 taken from below at ground level.

FIGS. 4 and 5 illustrates a partial transition of the workstation 80 from the fully expanded configuration depicted in FIGS. 1 through 3 to a collapsed configuration. In the illustration of FIG. 4, an arrow 102 indicates telescoping of the smaller cross-sectional lower section of the right-hand front leg 47 into the larger cross-sectional upper section thereof. When all of the legs 47, 48, 49, 50 are telescoped to their shortest length the doors 30, 31 can be collapsed against the lower surface 82 of the platform 10. An arrow 104 indicates than when collapsing the left-hand door 31 the upper end of the left-hand front angle brace 38 moves from that end of the left-hand U-shaped slot piercing the front attachment 41 nearest to the left-hand door hinge 33 to the other end thereof which is furthest from the left-hand door hinge 33. A curved arrow 106 indicates than when collapsing the right-hand door 30 it rotates about the right-hand door hinge 32 and the right-hand front angle brace 37 jackknifes so the right-hand door 30 ultimately becomes folded against the lower surface 82 of the platform 10. The bottom view of FIG. 5 depicts the workstation 80 with both of the doors 30, 31 oriented perpendicular to the lower surface 82 of the platform 10 similar to the position of the left-hand door 31 illustrated in FIG. 4. In the illustration of FIG. 5, all of the angle brace locks 43, 44, 45, 46 are located in those ends of the U-shaped slots respectively piercing the attachments 41, 42 that are respectively furthest from the hinges 32, 33.

Figure 8:
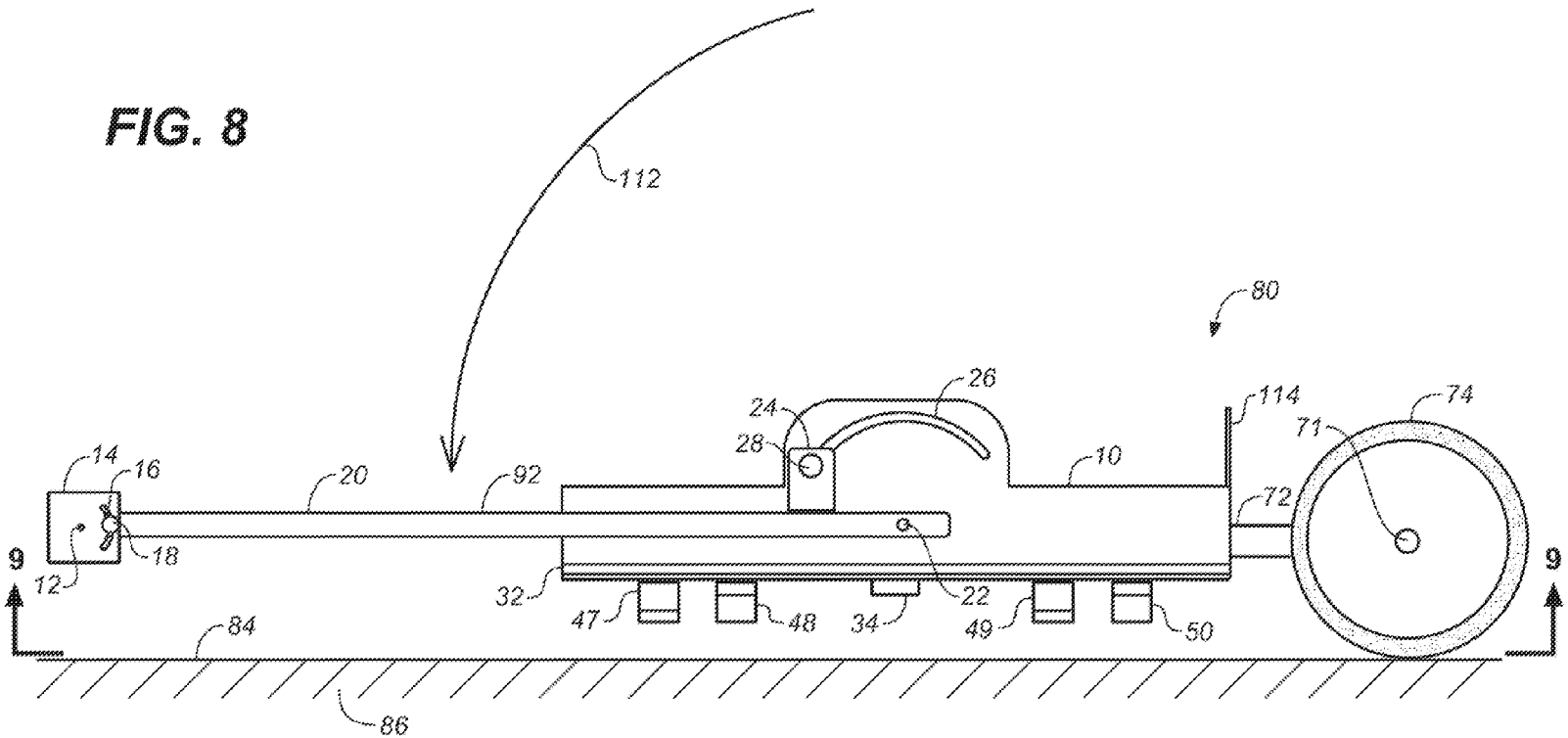
FIG. 8 is a side elevational view of the portable, self-contained pc-camera workstation in the fully collapsed configuration resting on the ground taken along the line 8-8 in FIG. 7.
Figure 9:
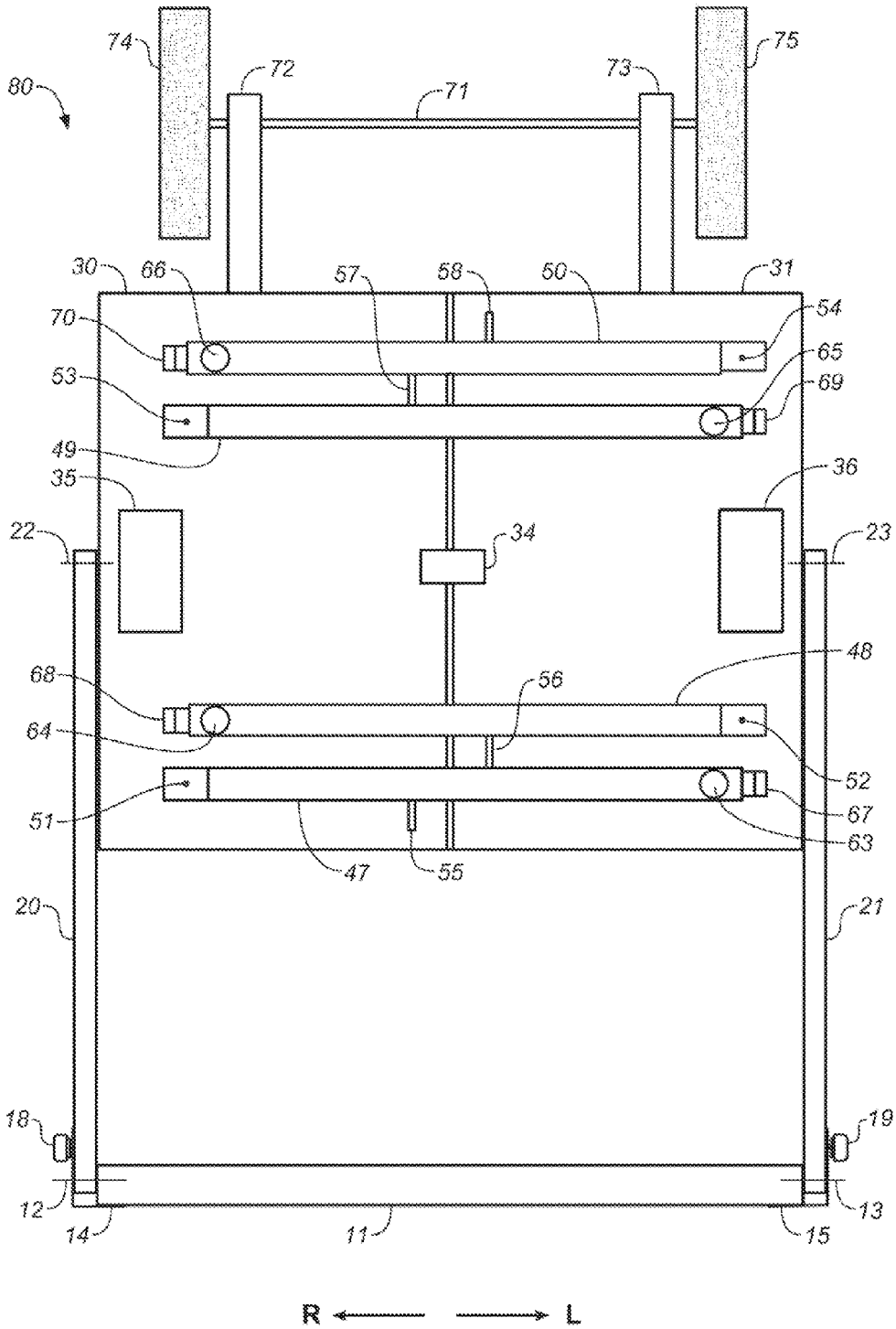
FIG. 9 a plan view of the portable, self-contained pc-camera workstation in the fully collapsed configuration taken from below along the line 9-9 in FIG. 8.

FIGS. 6 through 9 illustrate the workstation 80 when fully collapsed. In the configuration illustrated in FIGS. 6 through 9, the platform 10, the wheels 74, 75, and the handle 92 are substantially coplanar with the doors 30, 31 oriented against the lower surface 82 of the platform 10. The collapsed configuration for the workstation 80 facilitates rolling the wheels 74, 75 on the surface 84 of the ground 86. A curved arrow 112 in FIG. 8 indicates reorienting the instrument mounting bar 11 and arms 20, 21 from a configuration in which they extend above the platform 10 for receiving and having affixed thereto either a instrument or camera to a second orientation in which they provide the handle 92 for transporting the workstation 80. FIG. 8 also illustrates a lip 114 that projects upward along an edge of the platform 10 nearest to the wheels 74, 75. The lip 114 blocks the lap-top computer 78 illustrated in FIG. 10 from falling off the back of the platform 10. FIG. 9 illustrates that each of the legs 47, 48, 49, 50 is located on the respective doors 30, 31 so that when the workstation 80 is collapsed with the doors 30, 31 oriented against the lower surface 82 of the platform 10 the legs 47, 48, 49, 50 become interdigitated to overlap the respective doors 30, 31 to which they are not secured.

Figure 11:
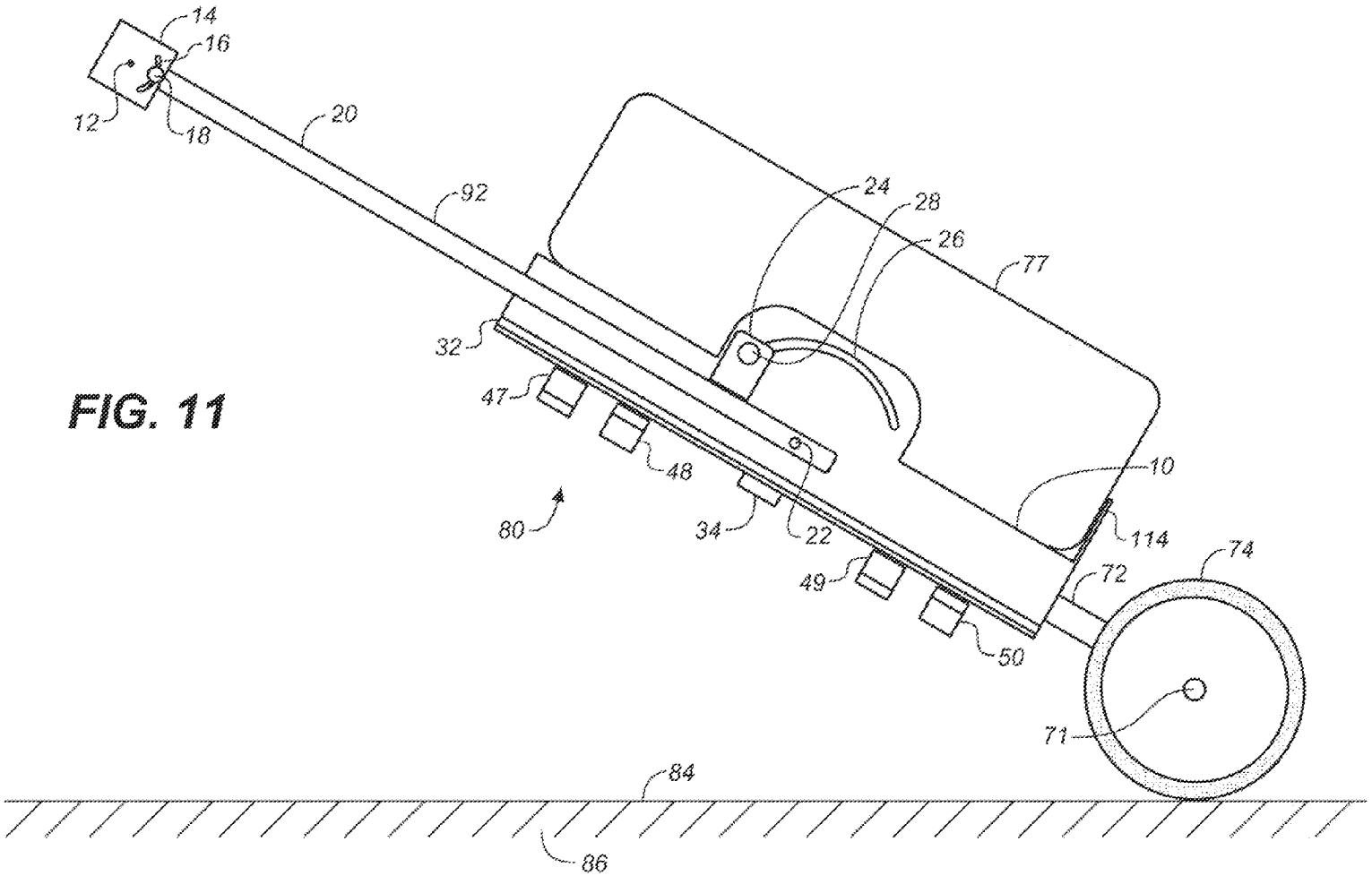
FIG. 11 is a side elevational view of the workstation in its collapsed configuration rolling on wheels across a surface.

FIG. 11 illustrates the collapsed workstation 80 rolling across the surface 84 on the wheels 74, 75 being pulled by the handle 92. In the illustration of FIG. 11 a carrying case 77 rests upon the platform 10 and is retained there by being juxtaposed with the lip 114. The carrying case 77, which may protect the camera 76 and the lap-top computer 78, is preferably secured to the platform 10 by belts, not illustrated in any of the FIGs. FIG. 11 illustrates that collapsing the workstation 80 facilitates transporting equipment that the workstation 80 supports when it is expanded.

Although the present invention has been described in terms of the presently preferred embodiment, it is to be understood that such disclosure is purely illustrative and is not to be interpreted as limiting. For example, while the preferred embodiment disclosed herein preferably includes four (4) legs 47, 48, 49, 50, a stable and useful workstation 80 need only include three (3) legs, two (2) legs secured to one of the doors 30, 31, and third leg secured to the other of the doors 30, 31. Analogously, while the workstation 80 preferably includes the wheels 74, 75, the workstation 80 remains useful for supporting an instrument or camera even if the wheels 74, 75 were omitted. The various components of the workstation 80 may be made from any suitable structural material such as metal, wood or plastic. Consequently, without departing from the spirit and scope of the disclosure, various alterations, modifications, and/or alternative applications will, no doubt, be suggested to those skilled in the art after having read the preceding disclosure. Accordingly, it is intended that the following claims be interpreted as encompassing all alterations, modifications, or alternative applications as fall within the true spirit and scope of the disclosure including equivalents thereof. In effecting the preceding intent, the following claims shall:

1. not invoke paragraph 6 of 35 U.S.C. §112 as it exists on the date of filing hereof unless the phrase "means for" appears expressly in the claim's text;
2. omit all elements, steps, or functions not expressly appearing therein unless the element, step or function is expressly described as "essential" or "critical;"
3. not be limited by any other aspect of the present disclosure which does not appear explicitly in the claim's text unless the element, step or function is expressly described as "essential" or "critical;" and
4. when including the transition word "comprises" or "comprising" or any variation thereof, encompass a non-exclusive inclusion, such that a claim which encompasses a process, method, article, or apparatus that comprises a list of steps or elements includes not only those steps or elements but may include other steps or elements not expressly or inherently included in the claim's text.

What is claimed is:

1. A portable, collapsible, self-contained workstation comprising:

a) a substantially planar platform adapted for receiving a lap-top computer;

b) a pair of doors respectively located beneath said platform, each door being hinged from said platform to be disposable and fixed in at least two (2) differing orientations:

i. a first orientation, when the workstation is collapsed, with said door being disposed against a lower surface of said platform; and ii. a second orientation in which said door extends away from said platform;

c) at least three (3) legs which are:

i. adapted together with said doors for supporting the platform from a surface; and ii. adjustable at least in length, a first pair of said legs being secured to a first of said doors and at least another of said legs being secured to a second of said doors, when said doors are oriented to extend away from said platform said legs being:

i. extendable away from said platform and fixable in the extended configuration; and ii. collapsible toward said platform; and d) a handle that is secured to said platform and is disposable and fixable in at least two (2) differing orientations, when said platform is being supported from a surface by said legs and said doors, one orientation of said handle being that in which said handle extends above said platform, said handle when oriented above said platform being adapted for receiving a camera that is fixed thereto.

2. The workstation of claim 1 further comprising at least one (1) wheel that is attached to said platform in a position which adapts said wheel for rolling along a surface when:

a) said handle is disposed in an orientation other than that in which said handle extends above said platform when said platform is being supported from a surface by said legs and said doors; and b) said workstation is:

i. collapsed with said doors oriented against the lower surface of said platform; and ii. not being supported from a surface by said legs and said doors.

3. The workstation of claim 2 wherein said handle, said platform, and said wheel are substantially coplanar when the workstation is collapsed with said doors oriented against the lower surface of said platform thereby configuring the workstation so said wheel is adapted for rolling along a surface.

4. The workstation of claim 2 wherein said handle is adapted for pulling the workstation when the workstation is collapsed with said doors oriented against the lower surface of said platform thereby configuring the workstation so said wheel is adapted for rolling along a surface.

5. The workstation of claim 2 wherein the workstation includes two (2) wheels.

6. The workstation of claim 5 wherein said handle is adapted for pulling the workstation when the workstation is collapsed with said doors oriented against the lower surface of said platform thereby configuring the workstation so said wheels are rolling along a surface.

7. The workstation of claim 1 wherein said legs are secured to said doors in locations which cause said legs to become interdigitated when said doors are collapsed against the lower surface of said platform.

8. The workstation of claim 1 wherein, when said platform is being supported from a surface by said legs and said doors, said doors and said legs are positionable so said legs diverge away from each other thereby increasing stability of the workstation.

9. The workstation of claim 1 wherein the workstation includes four (4) legs.

10. The workstation of claim 9 wherein said legs are secured to said doors in locations which cause said legs to become interdigitated when said doors are collapsed against the lower surface of said platform.

11. The workstation of claim 9 wherein, when said platform is being supported from a surface by said legs and said doors, said doors and said legs are positionable so said legs diverge away from each other thereby increasing stability of the workstation.

* * * * *